US007784751B1

(12) United States Patent
Bellows et al.

(10) Patent No.: US 7,784,751 B1
(45) Date of Patent: Aug. 31, 2010

(54) STABILIZING DEVICE, ALONG WITH MODULAR CONFIGURATIONS INCORPORATING THE SAME

(75) Inventors: Robert Bellows, Longmont, CO (US); John Mancino, Boulder, CO (US)

(73) Assignee: Focus 12 Inc., Boulder, CO (US)

( * ) Notice: Subject to any disclaimer, the term of this patent is extended or adjusted under 35 U.S.C. 154(b) by 5 days.

(21) Appl. No.: 12/113,604

(22) Filed: May 1, 2008

Related U.S. Application Data

(60) Provisional application No. 60/915,337, filed on May 1, 2007.

(51) Int. Cl.
*F16M 11/24* (2006.01)

(52) U.S. Cl. ..... 248/188.2; 248/346.11

(58) Field of Classification Search ..... 248/188.2, 248/649, 669, 354.1; 254/104; 52/126.1; 182/200, 201; 16/4, 10, 16, 17.1, 90
See application file for complete search history.

(56) References Cited

U.S. PATENT DOCUMENTS

| | | | | | |
|---|---|---|---|---|---|
| 1,045,984 | A | | 12/1912 | King | |
| 1,901,287 | A | | 3/1933 | Corriveau | |
| 2,709,571 | A | | 5/1955 | Mafera | |
| 2,819,037 | A | | 1/1958 | Wilkin | |
| 3,030,730 | A | | 4/1962 | Costar | |
| 3,381,937 | A | * | 5/1968 | Zillman | 254/104 |
| 3,684,233 | A | | 8/1972 | Vukich | |
| 3,836,118 | A | * | 9/1974 | Meyer | 254/104 |
| 4,135,335 | A | | 1/1979 | Jensen | |
| 4,625,489 | A | | 12/1986 | Bogle | |
| 4,776,548 | A | * | 10/1988 | Bezenek | 248/188.2 |
| 4,830,320 | A | | 5/1989 | Bellows | |
| 5,249,767 | A | * | 10/1993 | Mellen | 248/188.2 |
| 5,538,183 | A | * | 7/1996 | McGee | 238/14 |
| 5,807,021 | A | * | 9/1998 | Aaron | 404/19 |
| D406,028 | S | * | 2/1999 | Montgomery | D8/47 |
| 6,164,608 | A | * | 12/2000 | Schiel, Jr. | 248/188.2 |
| 6,616,128 | B2 | * | 9/2003 | Selzer | 254/104 |
| D502,556 | S | * | 3/2005 | Zimmerle et al. | D25/138 |
| D538,150 | S | * | 3/2007 | Burns et al. | D8/402 |
| 7,520,483 | B2 | * | 4/2009 | Rand et al. | 248/346.11 |

FOREIGN PATENT DOCUMENTS

| | | |
|---|---|---|
| DE | 2516129 | 12/1975 |

* cited by examiner

*Primary Examiner*—Gwendolyn Baxter
(74) *Attorney, Agent, or Firm*—Holland & Hart LLP

(57) ABSTRACT

A stabilization device is provided that includes a resilient body that has an upper surface and a lower surface. The body includes a first set of teeth located on the upper surface and distributed about a first axis. The teeth are spaced apart from one another by a selected pitch. The body also includes a second set of teeth located on the upper surface and distributed about a second axis. Like the first set the second set of teeth are spaced apart a selected second pitch. The first and second sets of teeth are offset from each other along either the first or second axis. The lower surface of the body preferably includes a similar arrangement of teeth.

35 Claims, 7 Drawing Sheets

STABILIZING DEVICE, ALONG WITH MODULAR CONFIGURATIONS INCORPORATING THE SAME

BACKGROUND OF THE INVENTION

The present invention is directed to a stabilizing device, which is adapted for insertion between a support surface and the lower support structure of an article in order to help support and stabilize the article against instability that is caused by an uneven structural support of the article or the support surface. This instability results in tipping, wobbling, or vibration when the distribution of weight on the article is disturbed by jarring forces, and the like. The stabilizing device thus may also be used to help level an otherwise evenly supported article on an uneven support surface. Accordingly, the field of the present invention is directed to the leveling and stabilizing of articles, such as furniture and the like, which rest on a support surface, such as a floor, in order to prevent wobbling, tipping, or vibration during use.

Most articles of furniture are constructed to have a lower support structure, which defines a support plane at its lowermost points. The operative or working areas of the article of furniture are then oriented in a desired manner with respect to that support plane by the support structure. For example, a typical table has a horizontal dining surface, which is oriented parallel to the floor and supported by four downwardly depending legs. Thus, the support plane of this table is the plane defined by the free ends of the legs. However, planar geometry dictates that only three operative support points define a plane. Thus, it is necessary that the table legs be sized with great care in order to ensure that all four free ends terminate in a common plane; otherwise, the table will be unstable. When this happens, the article does not have a single stable support plane but rather is subject to unwanted wobbling, tipping, or as in the case of machinery—vibrating. Even articles, which have only three support points, such as a three-legged table, that automatically define a stable support plane, can still have the problem that the working surface may not be in the desired orientation due to any error in the intended length of any support.

Other articles that have rotating components, such as pumps, air-conditioners, fans, and the like, can vibrate if not properly leveled and stabilized. For example, an air-handling unit might include a fan. If the fan is not perfectly balanced then any instability in the support of the air-handling unit on its support surface might allow the unit to vibrate. In some cases this vibration can be sufficient to cause damage to the unit. Also, the vibration can cause unwanted noise.

Accordingly, there has been a long-felt need for mechanical structures and devices, which can level or otherwise stabilize articles. To this end, some articles are provided with adjustable pads on their lower supports with these pads typically being threaded bolts which terminate in support pads or heads. These threaded bolts move into and out of the lower supports to define an adjustable support plane. Thus, the support pads may be threadably adjusted so that all of the common support points are in a common plane. Other techniques of leveling items such as heavy machinery include the use of a pair of freely sliding wedges, which are interconnected by means of a threaded shaft; a torque applying assembly interconnects the wedges so that they may be forcibly slid with respect to one another to provide vertically adjustable supports for the machine.

My earlier U.S. Pat. No. 4,830,320 is directed to a device, which is insertable between a support surface and a lower portion of an article in order to help stabilize and level the article on the support surface. This device is low cost, convenient, and adaptable to many applications where leveling, shimming or stabilizing is needed. In fact, this earlier device has been found to be useful not only for leveling and stabilizing furniture, but also for shimming work projects, vibration control of industrial equipment, and surface protection to name a few applications. While my previous device is convenient for many applications, there is still a need for a device, which is particularly adapted for shimming work projects, vibration control of industrial equipment, surface protection, and the like.

SUMMARY

A stabilization device is provided that includes a resilient body that has an upper surface and a lower surface. The body includes a first set of teeth located on the upper surface and distributed about a first axis. The teeth are spaced apart from one another by a selected pitch. The body also includes a second set of teeth located on the upper surface and distributed about a second axis. Like the first set the second set of teeth are spaced apart a selected second pitch. The first and second sets of teeth are offset from each other along either the first or second axis. The lower surface of the body preferably includes a similar arrangement of teeth.

The first set may include a plurality of first rows of first teeth each centered along a respective first axis and the second set may include a plurality of second rows of second teeth each centered along a respective second axis. Each of the first rows in the first set is offset from each of the second rows in the second set along its respective first axis. The teeth of the first set preferably have a common alignment and likewise the teeth of the second set preferably have a common alignment.

In at least one embodiment each second row has a width less than the width of each first row. The second set may include a pair of outer rows and an inner row such that the outer rows border the first set. Additionally, the inner rows may be interposed between respective first rows. Preferably the rows extend along a majority of the length of the body.

The upper and lower surfaces of the stabilization device may diverge from a common vertex to form a wedge shape and have upper and lower surfaces shaped as a rectangle, a circle, or an oval. The body may include a notched region to permit grasping by a removal tool. The body may also include mounting holes. The stabilization device may include a plurality of like body members hingedly joined, and such that the body members are separable along each hinge of the stabilization device.

The stabilization device body may be formed from a soft material, such as polyethylene, polyvinylchloride, and rubber or a stiff yet flexible material, such as polypropylene, polycarbonate, and acetal. The body may include a cavity sized and adapted to accommodate a foot portion of a legged article. A cavity may also be formed in the body where the body comprises a primary mold piece material and the cavity is filled with a secondary filler material, such as a material softer than the primary mold material or a material that has magnetic properties. Also, the body may comprise two different materials, each having different resiliency characteristics.

The stabilization device will become more readily appreciated and understood from a consideration of the following detailed description of the preferred embodiments when taken together with the accompanying drawings, in which:

DETAILED DESCRIPTION

The present invention is, in one sense, directed to a novel and useful device, which is insertable between a support surface and a lower portion of an article in order to help stabilize and/or level the article on the support surface. In other applications this device is particularly adapted for shimming work projects, vibration control of industrial equipment, surface protection, and the like. It should be noted that the term stabilizing, as used herein, is without limitation referring to stabilizing, supporting, leveling, shimming, surface protection, vibration control, and the like. The present device incorporates features for ease of installation and removal, enhanced nesting between different sized wedges, vibration control, surface protection, and interlocking of the wedges.

Figure 1:
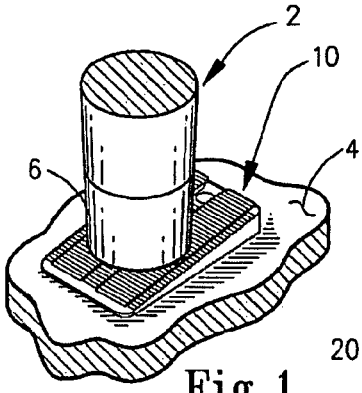
FIG. 1 is a perspective view of the stabilizing device according to a first exemplary embodiment in a support position between a support leg of an article of furniture and a support surface.

As is shown in FIG. 1, stabilizing device 10 is representatively adapted for insertion between a lower support portion of an article of furniture and the like, such as table leg 2, and support surface 4 in order to stabilize the article of furniture against tipping, rocking or other unwanted wobbling movement. Thus, as is seen in FIG. 1, free-end 6 of leg 2 rests directly on stabilizing device 10 which is, itself, positioned on support surface 4.

The structure of stabilizing device 10 is best shown in FIGS. 2-5. Stabilizing device 10 has a main body which includes an upper surface 20 and a lower surface 40 which have a common vertex 30 and are outwardly divergent from one another from vertex 30 to an end surface 50 to define a direction of divergence as is shown by arrow D. Surfaces 20 and 40 diverge at an angle Ø. Preferably, angle Ø is selected to be within a range of 10 to 20 degrees, inclusively. First and second sidewalls 36 and 38 extend between upper surface 20 and lower surface 40.

Figure 2:
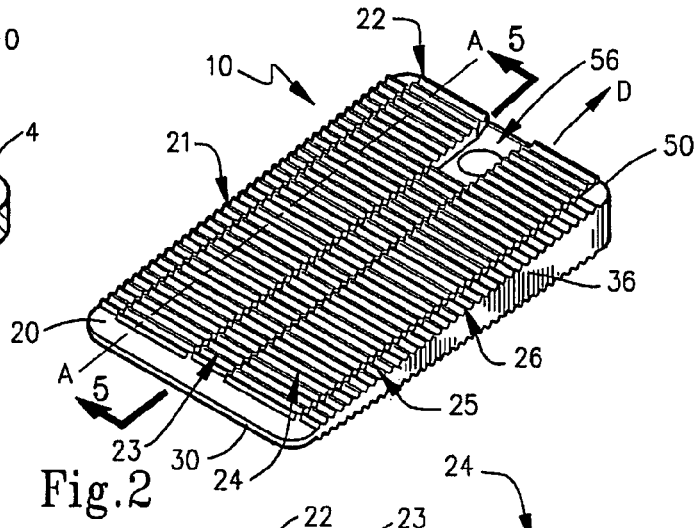
FIG. 2 is an enlarged perspective view of the stabilizing device shown in FIG. 1 showing the upper surface thereof.

As is best shown in FIG. 2, upper surface 20 is preferably formed as a flat plane and is provided with five rows 21-25 of first rib-like teeth, generally 26. These rows 21-25 each extend along a respective row axis, such as for example axis "A". Rib-like teeth 26 extend transversely to the direction of divergence. Shown in FIG. 3, lower surface 40 is also provided with five rows 41-45 of second teeth 46. Again, second teeth 46 are rib-like teeth, which extend transversely to the direction of divergence. As perhaps best shown in FIG. 4, first teeth 26 and second teeth 46 are formed similarly to each other, each having a truncated triangular cross-section.

Figure 4:
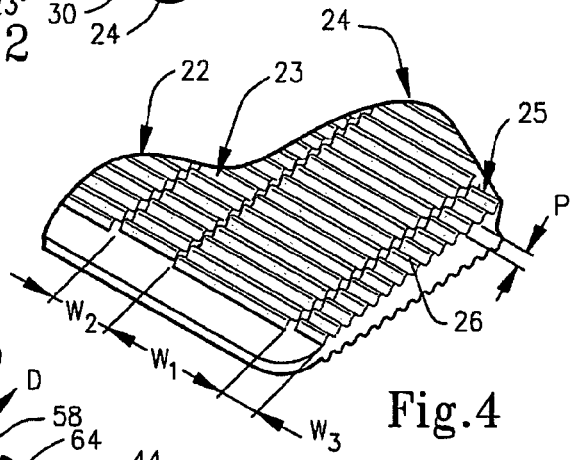
FIG. 4 is an enlarged partial perspective view of the upper surface of the stabilizing device.
Figure 3:
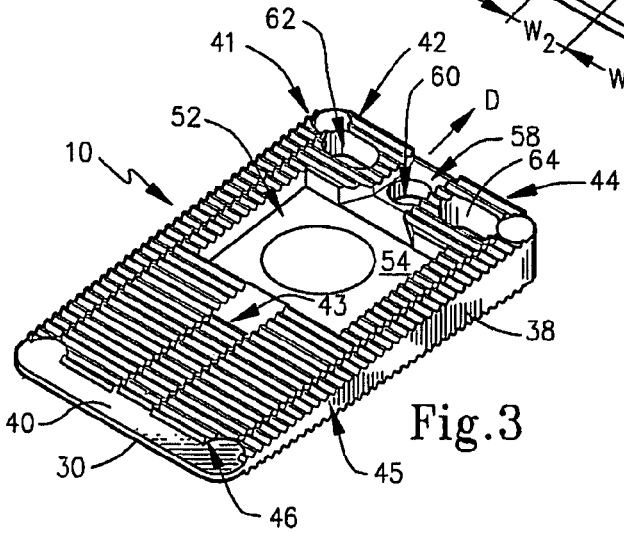
FIG. 3 is a perspective view of the stabilizing device shown in FIG. 2 showing the lower surface thereof.
Figure 5:
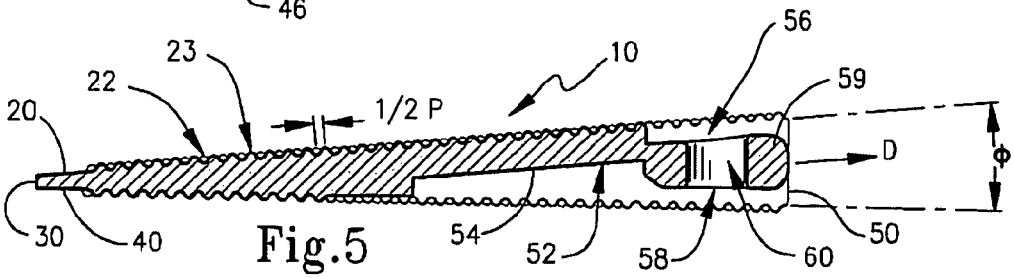
FIG. 5 is a cross-sectional view taken about lines 5-5 of FIG. 2.

With reference to FIG. 4, it should be noted that rib-like teeth 26 of each row are spaced on a pitch P. Advantageously, each alternate row of rib-like teeth 26 is offset by one-half the pitch P. For instance, in FIG. 4, row 25 is offset one-half pitch from row 24, and likewise, row 23 is offset one-half pitch from row 24. This offset arrangement of the rows of teeth provide interlocking of the teeth when multiple wedge devices 10 are stacked together in a selected configuration. It can be seen that the ends of each tooth prevent movement laterally to divergent direction D. It should be noted that in this embodiment that every other row is in common alignment with respect to pitch. For example rows 22 and 24 are in common alignment with each other.

Also shown in FIG. 4 are the dimensions for the rows of rib-like teeth 26. Rows 22 and 24 are of a width $W_1$. Row 23, which is the middle row, is a width $W_2$. Outer rows 21 and 25 are a width $W_3$. Width $W_2$ is approximately one-half of width $W_1$. Similarly, width $W_3$ is one-half of width $W_2$ and therefore is one-fourth of width $W_1$. These proportionate widths are advantageous when stacking the various embodiments of the device 10 as will be described in more detail below.

Figure 10:
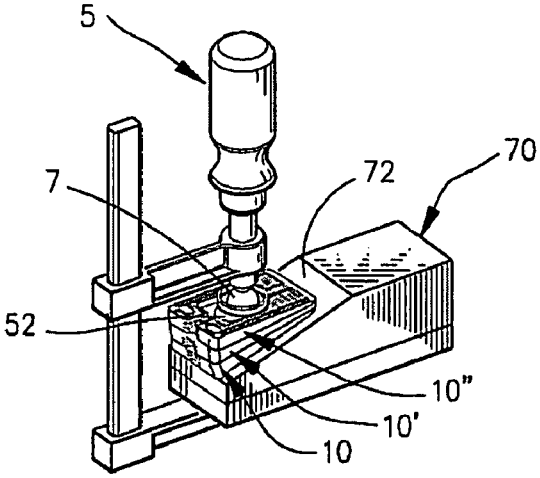
FIG. 10 is a perspective view showing a stacked configuration of stabilizing devices in conjunction with a clamp to hold a work piece with a ramped surface.

A cavity 52 is formed in lower surface 40 so that it has a bottom 54. Cavity 52 is suitable, for example, for receiving the clamp head of a clamp as shown in FIG. 10. Cavities 62 and 64 reduce the amount of material required to form, and thus the cost, of the stabilizing device 10. Alternatively, the cavities may be filled with a different filler material providing gripping or support properties to the device. Cavities 62 and 64 may also be filled with a filler material having magnetic properties. Channel 58 is formed in lower surface 40 so that it intersects cavity 52 and extends through end surface 50. Channel 56 is formed in top surface 20, and in conjunction with channel 58, form a narrowed or notched section 59 of reduced height compared to end surface 50. This notched section provides a "grab bar" that is accessible even when the stabilization device is fully inserted between two surfaces. Bore 60 is formed through the narrowed section 59 between channels 56 and 58. Bore 60 forms a carrying and mounting hole for device 10.

It should be appreciated from the foregoing that stabilizing device 10 is thus defined by a body member which has upper surface 20, lower surface 40, end surface 50, and a pair of side surfaces 36 and 38. These surfaces are constructed to define a wedge-shaped configuration having an attack vertex 30 defined by the line of intersection of the upper and lower surfaces 20 and 40. Accordingly, in one application, stabilizing device 10 may be inserted between a support surface and an article of furniture that is to be supported. Stabilizing device 10 is preferably formed by injection molding with a high-friction material, which is operative to prevent slippage once it is inserted between the lower support structure of the article of furniture and the support surface. Stabilizing device 10 may be constructed of a relatively stiff yet flexible material and may be a plastic material selected from a group consisting of polypropylene, polycarbonate, acetal, and the like. Alternatively, the stabilizing device 10 may be constructed of a soft gripping material such as polyethylene, polyvinylchloride (PVC), rubber, or the like. Other materials known in the art, plastic or otherwise, are also contemplated by this invention although these are the preferred materials. In shimming applications, the softer materials are of particular advantage in that they may be cut flush once installed. When leveling a toilet, for instance, a PVC stabilizing device may be cut trim and left in place to permanently level and stabilize the toilet. Using a stabilization device constructed of a soft material, such as PVC, has the additional benefit in this type of application of creating a counter-resistive force when bolted between two surfaces such as the toilet base and floor. This counter-resistive force improves the stability of the article being leveled or shimmed.

Figure 6:
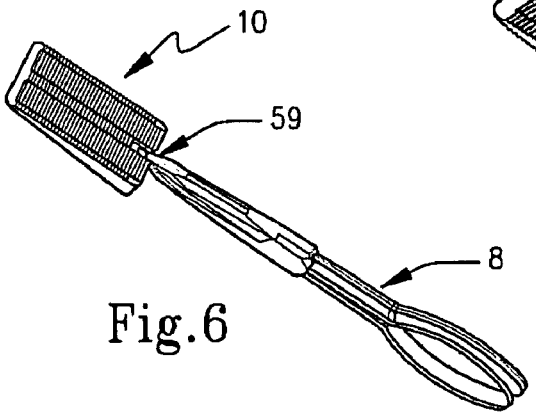
FIG. 6 is a perspective view of the stabilizing device being gripped by pliers for insertion and removal.

It should be appreciated that upper surface 20 and lower surface 40 complement each other so that a plurality of stabilizing devices may be stacked, one on top of the other, in a variety of configurations, thus providing a stabilization system. Respective teeth 26 and teeth 46 of respective devices engage one another to limit relative longitudinal slippage of adjacent ones of stabilizing devices. In addition, because alternate rows of stabilizing teeth 26 and 46 are offset by one-half pitch P, relative transverse slippage of adjacent ones of stabilizing devices is also limited. When stabilizing device 10 is used as an insert between a support surface and an article to be supported, vertex 30 defines an attack portion of the wedge-shaped body portion that forms stabilizing device 10 for initial insertion, for example, between free end 6 of leg 2 and support surface 4 (see FIG. 1). With reference to FIG. 6, it can be appreciated that narrow portion 59 facilitates the installation and removal of stabilizing device 10, allowing it to be grasped by a tool, such as needle-nose pliers 8, which grip the narrow portion 59.

Figure 7:
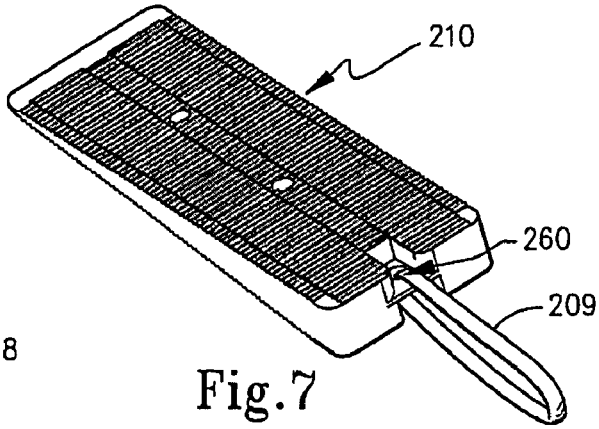
FIG. 7 illustrates a second exemplary embodiment of a stabilizing device, with a lanyard inserted therethrough.

FIG. 7 illustrates a second exemplary embodiment of the present invention 210 (described below with reference to FIGS. 12 and 13) with a lanyard 209 attached thereto, and specifically received through bore 260. Lanyard 209 also facilitates the removal of the stabilizing device after insertion and can additionally be used to carry one or more such devices. The lanyard 209 can be a strap, hook, or other item that engages the bore 260 facilitating removal or carrying of the stabilizing device. It should be understood that lanyard 209 could be used on any of the exemplary embodiments described herein. FIG. 7 also shows a new use for a known device. Specifically a lanyard could be used on the device described in my earlier U.S. Pat. No. 4,830,320. With a lanyard attached, removal and repositioning of the stabilizing device is more convenient. For instance, when leveling a countertop, if a wedge is inserted too far between a granite top, for example, and its supporting cabinets it is a simple matter to grasp the lanyard and pull the device from between the granite top and cabinets. Without the lanyard it is more difficult to retrieve the device.

Figure 8:
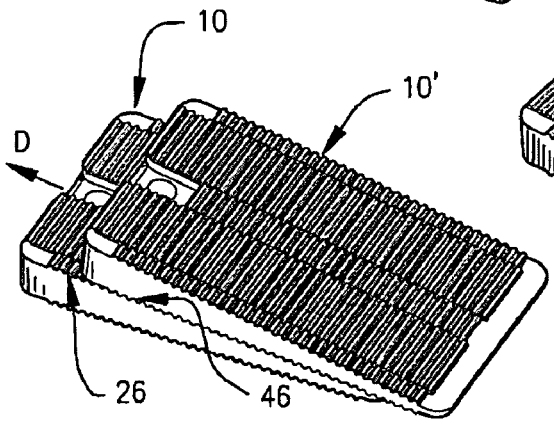
FIG. 8 is a perspective view showing a pair of stabilizing devices, according to the first embodiment, in a representative first stacked orientation.
Figure 9:
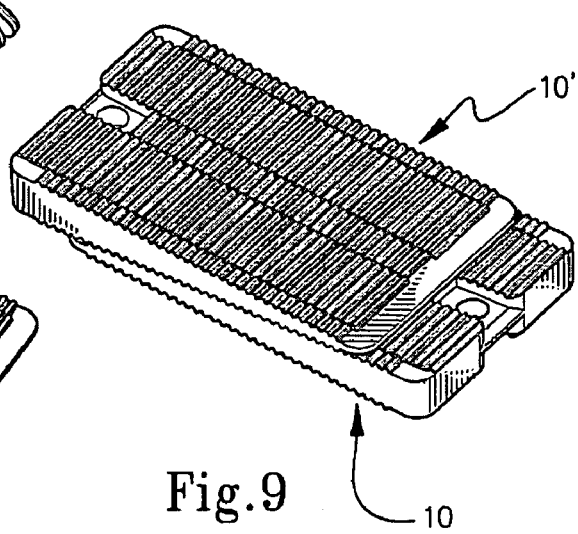
FIG. 9 is a perspective view showing a pair of stabilizing devices, according to the first embodiment, in a representative second stacked orientation.

Should a wedge-shaped body having a larger degree of divergence be desired, a pair of stabilizing devices 10 may be stacked, as is shown in FIG. 8. It can be appreciated that stacking the stabilizing devices, such that their vertices 30 are adjacent, creates a wedge-shaped body that has twice the degree of divergence (2*Ø) as the single device. As is shown in FIG. 8, a pair of devices 10 can also be stacked such that the lower surface of the first device engages an upper surface of the second device with teeth 46 engaging teeth 26. It should be appreciated that any desired arrangement of stacking is possible since surfaces, such as surfaces 20 and 40, complement one another in pitch P and row spacings $W_1$-$W_3$. Additional stabilizing devices may be added in any desired configuration of stacking, as should be readily understood, in order to increase the thickness and shape of the set of stabilizing devices. Also with respect to FIG. 8, stabilizing devices 10, 10' are offset longitudinally in direction D. This offset forms a longer wedge as well as a wedge of twice the angle of a single device. With reference to FIG. 9, stacking the devices in an opposed configuration creates a cradle or a block.

FIG. 10 illustrates the use of multiple stabilizing devices 10 in a clamping application. In this application, work piece 70 has an angled, or ramped, surface 72. In this case, three stabilizing devices are used in order to interface between clamp head 7 and angled surface 72. By stacking three of the stabilizing devices 10, 10', and 10", the angle of the combined wedges is approximately the same as angled surface 72. The complementary tooth construction of the devices reduces the risk that the individual devices will slide longitudinally with respect to each other. In addition, the rib-like teeth act as a grip on surface 72. It should also be noted that cavity 52 provides a pocket for clamp head 7 to rest.

Figure 11:
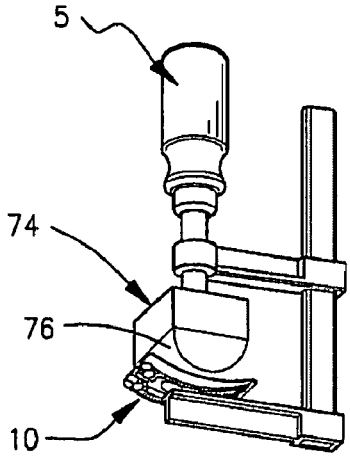
FIG. 11 is a perspective view similar to that of FIG. 10 but where the work piece has an arcuate (e.g. routed) surface.

FIG. 11 illustrates another application where stabilizing device 10 is useful. In this case, work piece 74 has a curved surface 76. In this case, stabilizing device 10 is constructed of a soft rubber-like material. This allows the stabilizing device 10 to conform to the curved surface 76 providing stability, while at the same time, preventing damage to the surface of the work piece.

Figure 12:
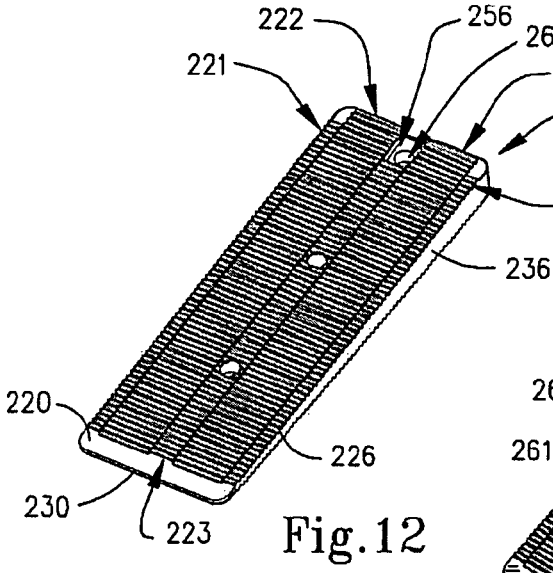
FIG. 12 is a perspective view of the stabilizing device according to the second exemplary embodiment, as introduced in FIG. 7, and showing the upper surface thereof.
Figure 13:
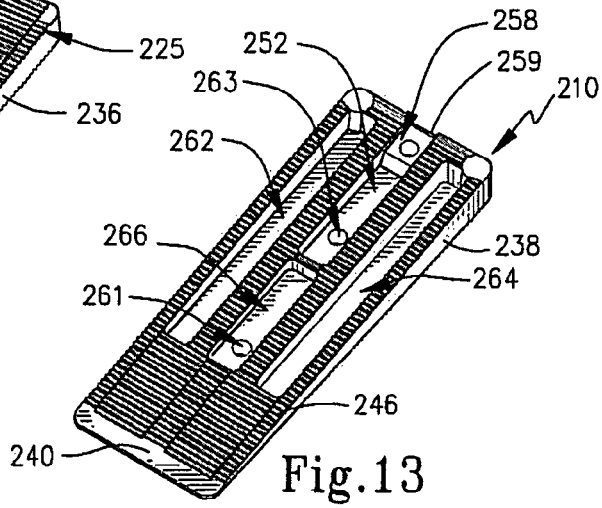
FIG. 13 is a perspective view of the stabilizing device of FIG. 12, and showing the lower surface thereof.
Figure 15:
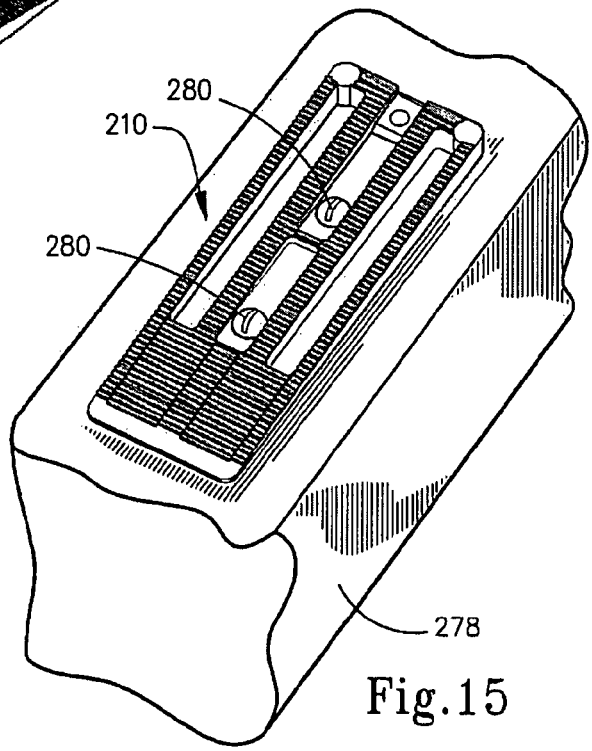
FIG. 15 is a perspective view illustrating the attachment of the stabilizing device to a work piece with screws.

FIG. 12 illustrates a second exemplary embodiment of the present invention. In this embodiment, the construction of the stabilizing device 210 is similar to that of the first embodiment. In particular, the tooth construction and row spacings are the same. However, as can be seen from the figures, lower surface 240 has multiple cavities formed therein. For instance, cavities 252, 266, 262, and 264 all provide compliance when a load is applied to the stabilizing device 210. In addition, the cavities conserve the amount of material necessary to form the stabilizing device, thereby reducing the cost of the device. Stabilizing device 210 also includes mounting holes 261 and 263. Mounting holes 261 and 263 may be used to mount the stabilizing device 210 to a work piece. For instance, FIG. 15 illustrates such an arrangement. Here, stabilizing device 210 is mounted to work piece 278 using screws 280.

Figure 14:
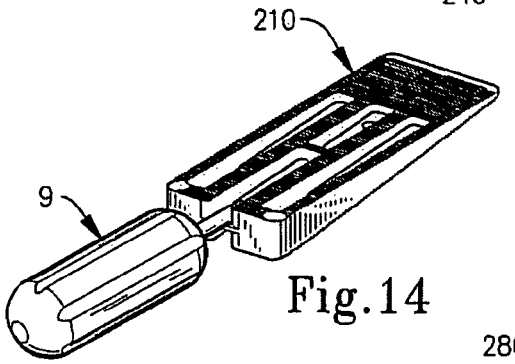
FIG. 14 is a perspective view showing the second exemplary embodiment of the stabilizing device being engaged by a screwdriver tool.

Stabilizing device 210 may be used in a manner similar to that of the first embodiment 10. Channel 258 of stabilizing device 210, however, is relatively more elongate to accommodate a screwdriver 9. As seen in FIG. 14, screwdriver 9 can be inserted into cavity 252 and engage the wall 252 in order to achieve a mechanical advantage and better urge stabilizing device 210 into an insertion position.

Figure 16:
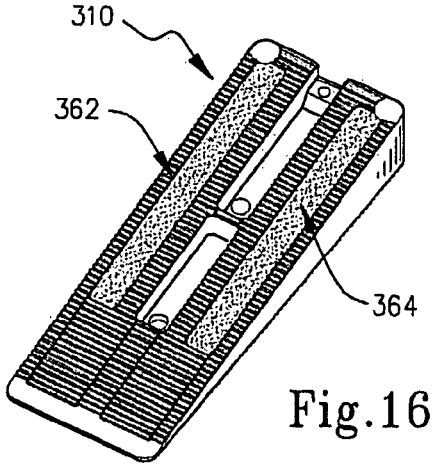
FIG. 16 is a perspective view of the stabilizing device according to a third exemplary embodiment showing the lower surface thereof with secondary material inserts.

FIG. 16 illustrates a third exemplary embodiment of the stabilizing device 310. Again, stabilizing device 310 is of similar construction to that of the second exemplary embodiment 210 shown in FIG. 12. However, cavities 362 and 364 are filled with a second material. In the case where the main body of stabilizing device 310 is made of soft material, the insert pieces 362 and 364 may be of a harder resin. Inserting a hard resin secondary wedge into a soft wedge would create a spine for support while simultaneously providing a soft outer surface with good gripping and vibration control characteristics. Alternatively, where stabilizing device body 310 is formed of a hard resin material, the inserts 362 and 364 may be filled with a soft secondary wedge material, providing heavy support as well as some vibration, isolation, and control. Magnetic material may also be used to fill the cavities. Incorporating magnets into the device may facilitate installation of the stabilizing device as well as stacking of multiple devices. Insert pieces 362 and 364 may be preformed and inserted into stabilizing device 310 or they may be glued into place. Alternatively, the insert material 362 may comprise a fillable material with adhesive properties, such as a potting material. It is also contemplated that the secondary material may be insert molded or otherwise formed with a secondary molding operation.

Figure 17:
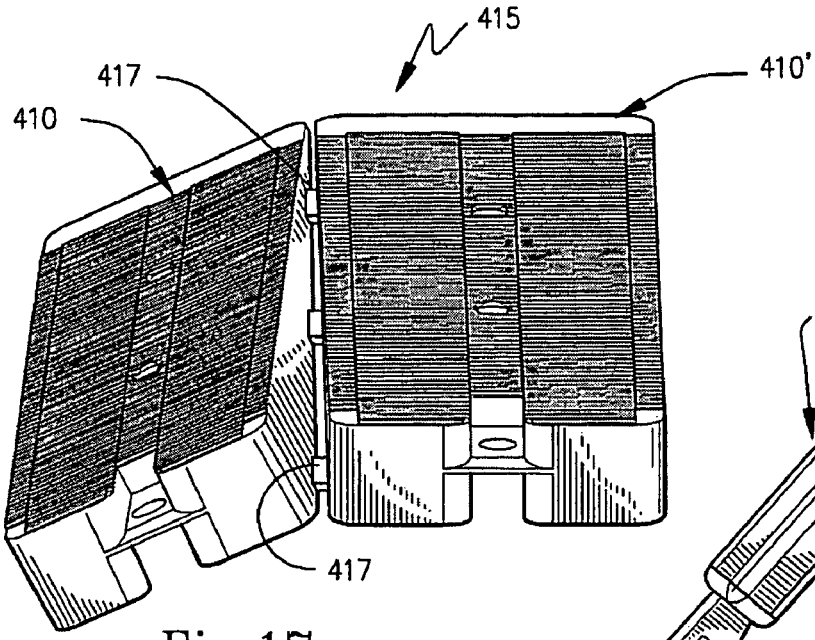
FIG. 17 illustrates a fourth exemplary embodiment of the stabilizing device having flexible hinges connecting two stabilizing sections.
Figure 18:
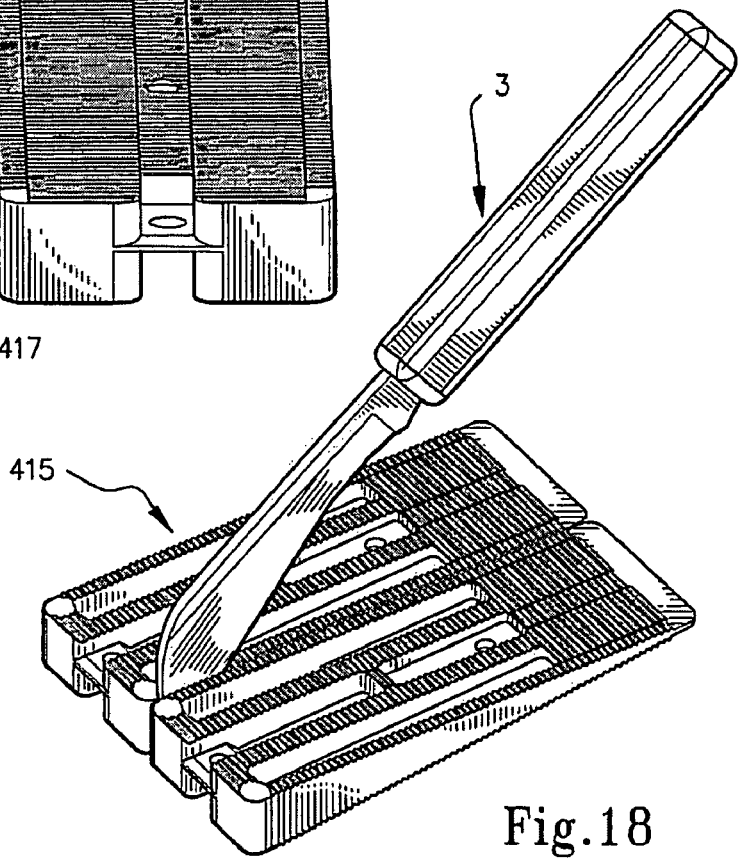
FIG. 18 is a perspective view of the fourth exemplary embodiment of the stabilizing device, illustrating the separation of the two sections by using a cutting implement, such as a knife.

FIG. 17 illustrates a fourth exemplary embodiment of the present invention where two stabilizing devices 410 and 410' are connected into one wedge by hinges 417. This embodiment provides a large area stabilizing device 415 which may also bend at the hinges 417 to conform to uneven surfaces. Hinged stabilization devices 410 and 410' are also well suited for packaging applications. For example, hinged wedges may be wrapped around the corners of a delicate piece of equipment and wedged against the shipping container, thus tightening, cushioning, and stabilizing the equipment. For smaller applications, stabilizing device 415 may be cut into two smaller stabilizing devices 410 by cutting hinges 417 with a cutting implement, such as a knife 8, as shown in FIG. 18.

Figure 19:
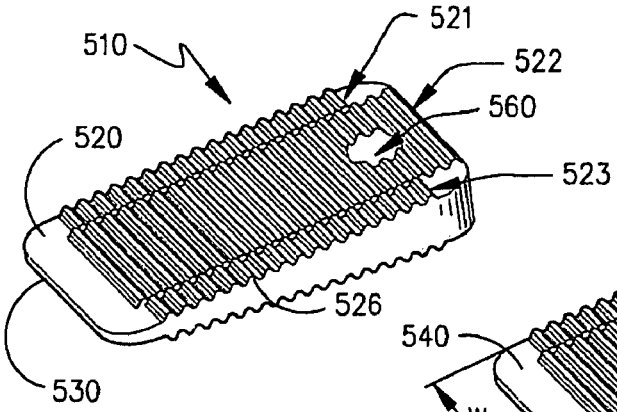
FIG. 19 is a perspective view of the stabilizing device according to a fifth exemplary embodiment showing the upper surface thereof.
Figure 20:
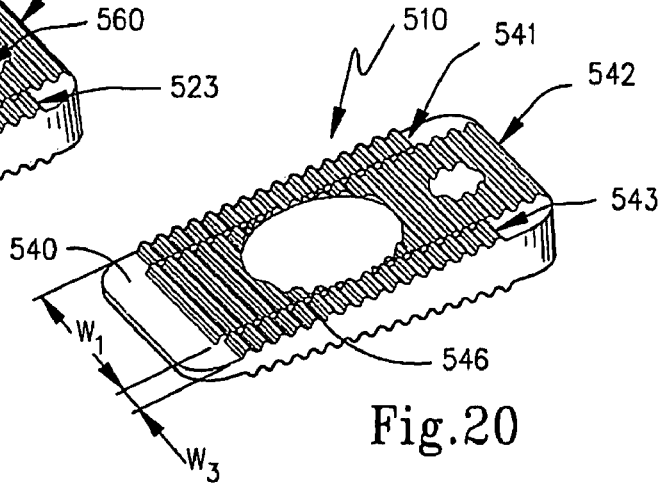
FIG. 20 is a perspective view of the stabilizing device shown in FIG. 19 showing the lower surface thereof.

FIGS. 19 and 20 illustrate a fifth exemplary embodiment of the present invention. In this embodiment, stabilizing device 510 is of a similar structure to the previous embodiments. However, it does not incorporate the cavities. In addition, it has three rows of rib-like teeth 521, 522, and 523 rather than five rows. Like the other embodiments, the stabilizing device 510 also has a lower surface 540, which has offset rows of teeth 541, 542, and 543 comprised of rib-like teeth 546. It should be noted that the relative dimensions of each row are similar to those of the previous embodiments. For example, row 542 is of a width $W_1$ corresponding to the width of rows 24 and 22 of the first embodiment. Similarly, rows 541 and 543 are of a width $W_3$, which corresponds to width $W_3$ for rows 21 and 25 of the first embodiment in FIGS. 1-5. By using the same dimensions for all of the embodiments, all of the embodiments are stackable with each other in various combinations.

Figure 21:
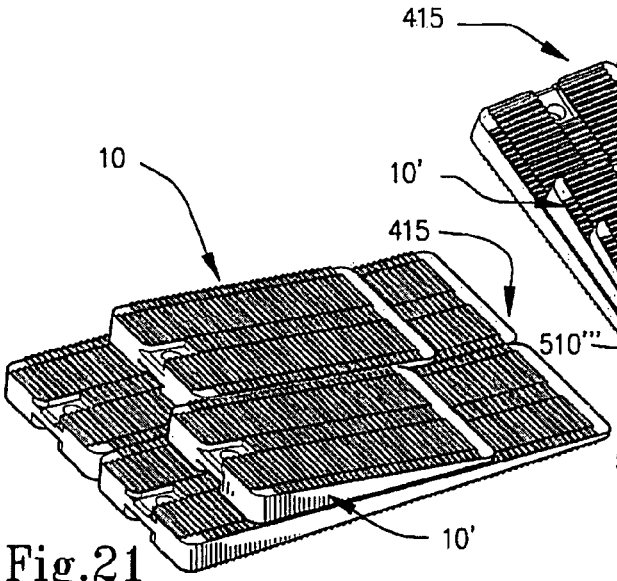
FIG. 21 is a perspective view of a third representative combination of stabilizing devices.
Figure 22:
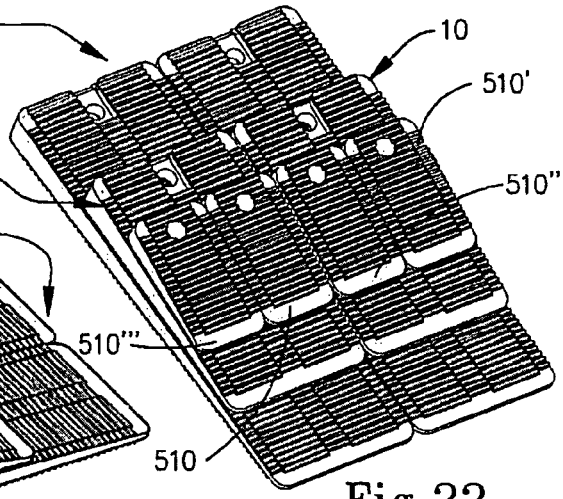
FIG. 22 is a perspective view of a fourth representative combination of stabilizing devices.

FIGS. 21-26 illustrate various combinations of the exemplary embodiments of the stabilizing device. FIG. 21, for example, illustrates the combination of stabilizing device 415 with stabilizing device 10. It should also be noted that the stabilizing device 10 may be positioned at any point along the surface 220. FIG. 22 illustrates the addition of several smaller stabilizing devices 510, 510', 510", and 510'". The stabilizing devices may be stacked in combinations of different material to provide not only a resilient support surface but a vibration controlling and dampening surface as well. For example, in FIG. 22, the combination of stabilizing devices may include stabilizing device 415 formed of a stiff yet resilient plastic while intermediate stabilizing devices 10 and 10' may be formed of soft material such as rubber. And finally, the stabilizing devices 510, 510', 510", and 510'" may again be formed of a hard material such as plastic. It is contemplated that stabilizing devices of various sizes and materials, such as described with respect to FIG. 22, may be combined and packaged to provide a stabilization system kit.

Figure 23:
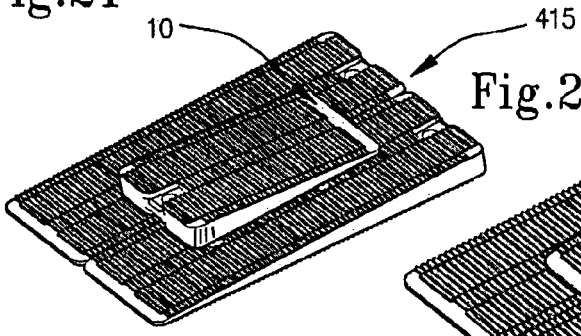
FIG. 23 is a perspective view of a fifth representative combination of stabilizing devices.
Figure 24:
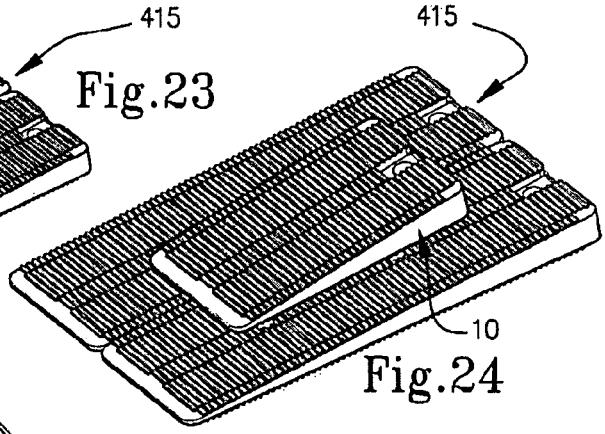
FIG. 24 is a perspective view of a sixth representative combination of stabilizing devices.
Figure 25:
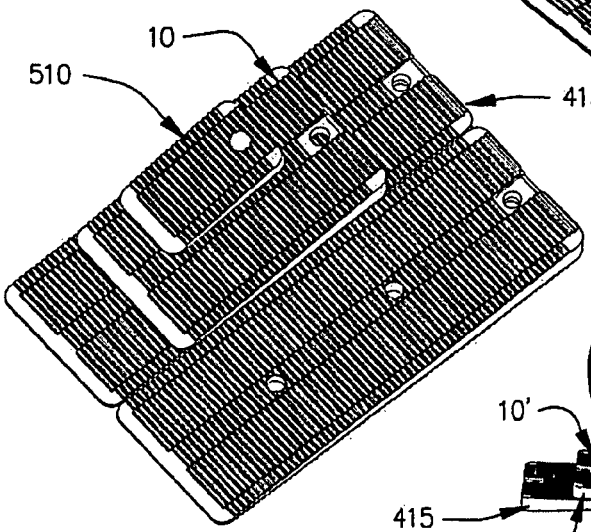
FIG. 25 is a perspective view of a seventh representative combination of stabilizing devices.
Figure 26:
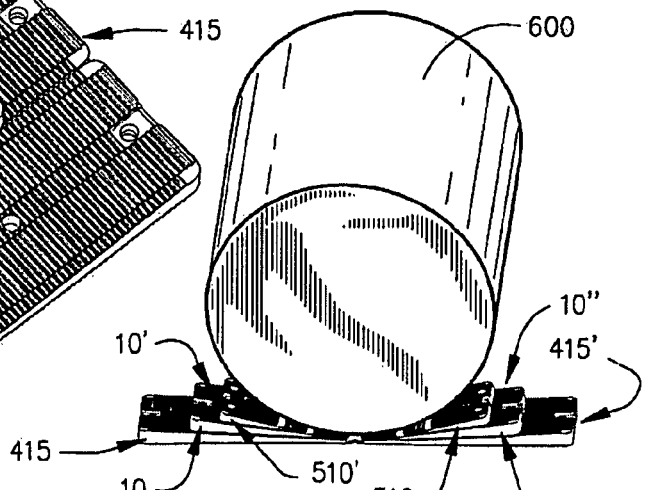
FIG. 26 is a perspective view illustrating the fourth representative combination of stabilizing devices, as shown in FIG. 22, being used to stabilize work piece in the form of a large round bar.
Figure 27:
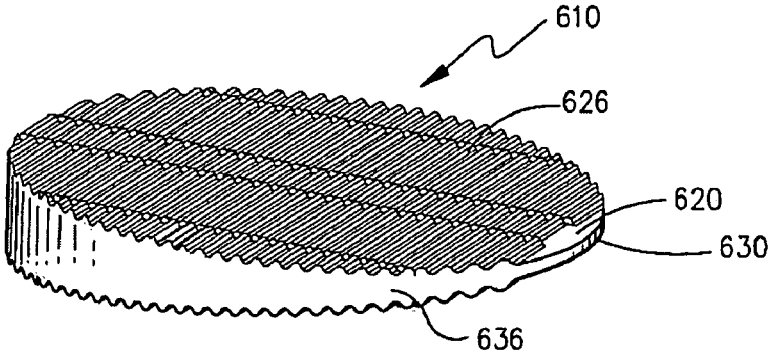
FIG. 27 is an enlarged perspective view of the stabilizing device according to a sixth exemplary embodiment showing the upper surface thereof.
Figure 28:
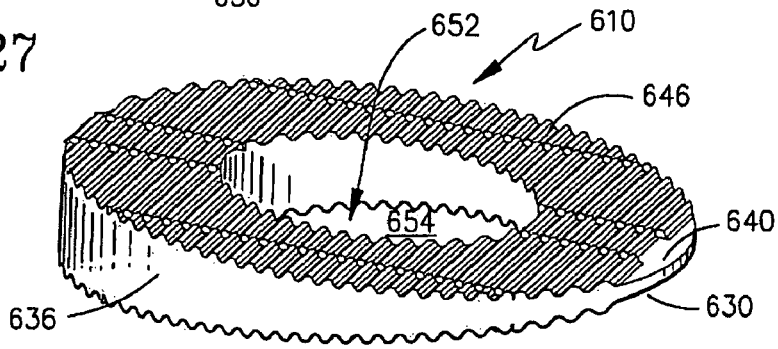
FIG. 28 is a perspective view of the stabilizing device shown in FIG. 27 showing the lower surface thereof.
Figure 29:
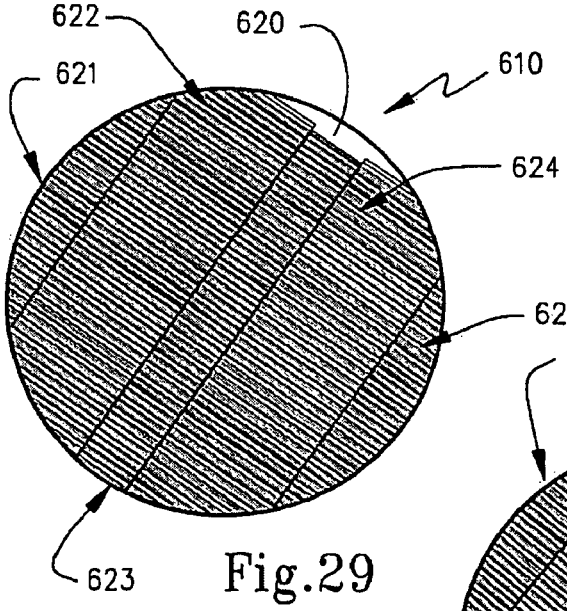
FIG. 29 is a top plan view of the stabilizing device shown in FIG. 27.
Figure 30:
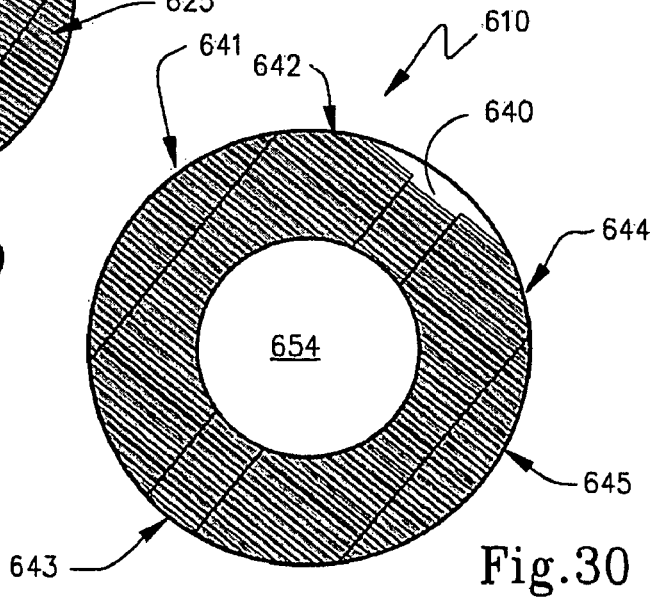
FIG. 30 is a bottom plan view of the stabilizing device shown in FIG. 27.
Figure 31:
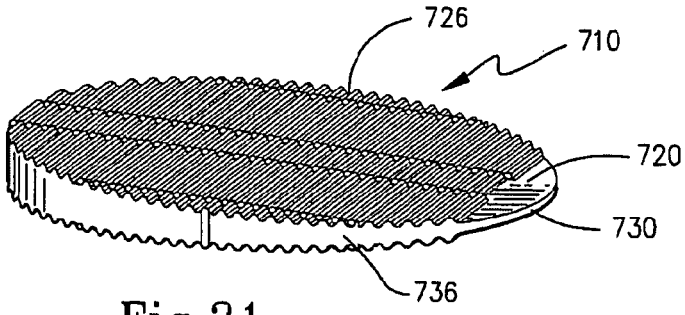
FIG. 31 is an enlarged perspective view of the stabilizing device according to a seventh exemplary embodiment showing the upper surface thereof.
Figure 32:
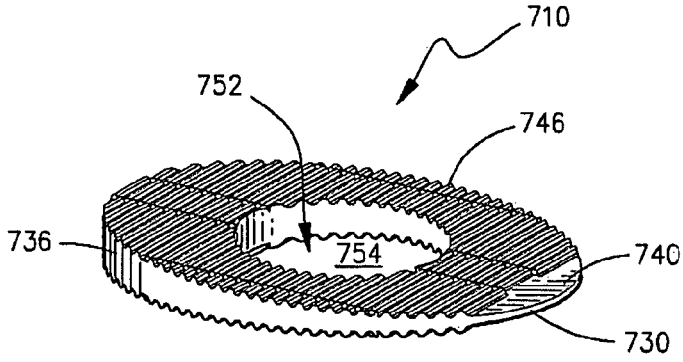
FIG. 32 is a perspective view of the stabilizing device shown in FIG. 31 showing the lower surface thereof.
Figure 33:
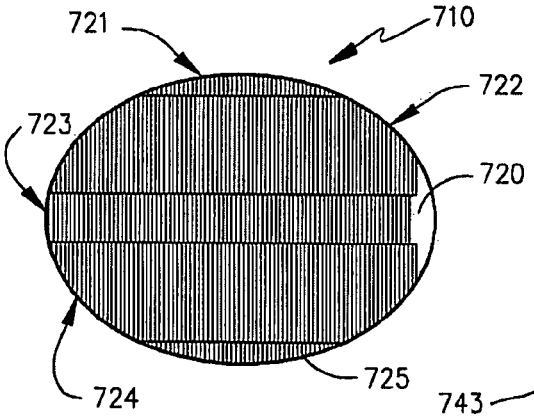
FIG. 33 is a top plan view of the stabilizing device shown in FIG. 31.
Figure 34:
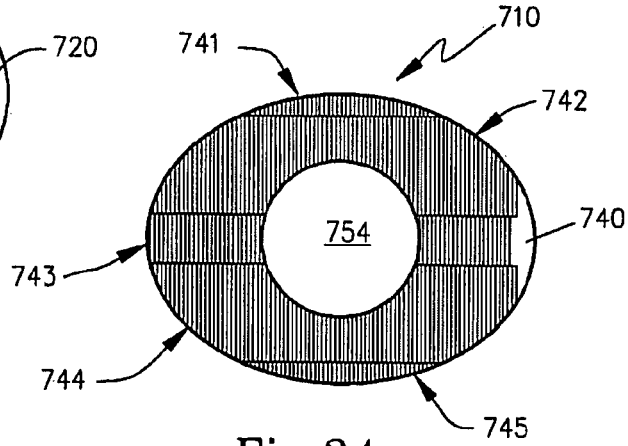
FIG. 34 is a bottom plan view of the stabilizing device shown in FIG. 31.

FIGS. 23 and 24 illustrate the combination of the larger embodiment of the stabilizing device 415 in combination with the intermediate stabilizing device 10. In FIG. 23, the stabilizing device 10 is stacked oppositely to the stabilizing device 415, whereas in FIG. 24, stabilizing device 10 is stacked with the vertex proximate the vertex of the stabilizing device 415. FIG. 25 illustrates a combination similar to that of FIGS. 23 and 24 with the addition of small stabilizing device 510. By stacking the stabilizing devices in decreasing size, in a corner of each subsequent device (shown here as the upper left-hand corner), a compound angle can be supported. FIG. 26 illustrates the use of a combination similar to that described with respect to FIG. 22 to create an adjustable cradle in order to prevent a large round bar, for example, from rolling or moving.

FIGS. 27-30 illustrate a sixth exemplary embodiment of the present invention. In this embodiment, stabilizing device 610 is of a similar structure to the previous embodiments in that it has five rows of rib-like teeth 621-625. In this embodiment, however, the stabilizing device is round in shape and has a surrounding side-wall 636. This rounded configuration is particularly well suited for use in stabilizing furniture with rounded legs or feet. The rounded configuration of device 610 may be more aesthetic and concealable in these applications. Like the above mentioned embodiments, the stabilizing device 610 also has a lower surface 640, which has offset rows of teeth 641-645 comprised of rib-like teeth 646. Here again, it should be noted that the relative dimensions of each row are similar to those of the previous embodiments. For example, rows 642 and 644 are of a width $W_1$ corresponding to the width of rows 24 and 22 of the first embodiment. Also similar to the previous embodiments, stabilizing device 610 includes a cavity 652. In this case, cavity 652 is round in shape. Accordingly, cavity 652 may receive the glide that is commonly attached to the foot of many types of furniture. This conveniently maintains the device in position between the article of furniture and the support surface.

FIGS. 31-34 illustrate a seventh exemplary embodiment of the present invention. This embodiment is similar to that shown in FIGS. 27-30, but has an oval configuration with surrounding sidewall 736.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

What is claimed is:

1. A stabilization device comprising a resilient body having an upper surface and a lower surface that diverge from a common vertex, said upper and lower surfaces each including;

a) a first set of first teeth distributed about a first axis, said first teeth spaced apart from one another a selected first pitch; and b) a second set of second teeth distributed about a second axis, said second teeth spaced apart from one another by a selected second pitch, said second teeth being offset from said first teeth along said second axis.

2. A stabilization device according to claim 1 wherein each of said upper and lower surfaces has a shape selected from a group consisting of a rectangle, a circle, and an oval.

3. A stabilization device according to claim 1 wherein said resilient body is formed from a soft material or a stiff yet flexible material.

4. A stabilization device according to claim 1 wherein said resilient body comprises a resilient material selected from a group consisting of polyethylene, polyvinylchloride, and rubber.

5. A stabilization device according to claim 1 wherein said resilient body comprises a resilient material selected from a group consisting of polypropylene, polycarbonate, and acetal.

6. A stabilization device according to claim 1 wherein said first teeth are arranged as a first row centered along said first axis and said second teeth are arranged as a second row centered along said second axis.

7. A stabilization device according to claim 1 wherein said first set includes a plurality of first rows of first teeth each centered along a respective first axis and said second set includes a plurality of second rows of second teeth each centered along a respective second axis.

8. A stabilization device according to claim 7 wherein each of said first rows in said first set is offset from each of said second rows in said second set along its respective said first axis.

9. A stabilization device according to claim 8 wherein said first teeth of said first set have a common alignment.

10. A stabilization device according to claim 9 wherein said second teeth of said second set have a common alignment.

11. A stabilization device according to claim 8 wherein said second teeth of said second set have a common alignment.

12. A stabilization device according to claim 7 wherein each said second row has a width less than the width of each said first row.

13. A stabilization device according to claim 12 wherein said second set includes a pair of outer rows and at least one inner row, said outer rows bordering said first set.

14. A stabilization device according to claim 13 wherein said inner rows are interposed between respective said first rows.

15. A stabilization device according to claim 13 wherein each said outer row has a width less than each said inner row.

16. A stabilization device according to claim 15 wherein each said outer row is one-half the width of each said inner row.

17. A stabilization device according to claim 16 wherein each said row extends along a majority of the length of said body.

18. A stabilization device according to claim 1 wherein said body includes at least one mounting hole formed therethrough.

19. A stabilization device according to claim 1 wherein said body includes a cavity formed therein.

20. A stabilization device according to claim 19 wherein said cavity is sized and adapted to accommodate a foot portion of a legged article.

21. A stabilization device according to claim 19 wherein said body is formed of a first resilient material and said cavity contains a second material different than the first.

22. A stabilization device according to claim 1 wherein said body includes a notched region to permit grasping by a removal tool.

23. A stabilization device according to claim 1 wherein said body comprises two different materials, each having different resiliency characteristics.

24. A stabilization device according to claim 23 wherein said body comprises a primary mold piece material and a secondary filler material.

25. A stabilization device according to claim 24 wherein said secondary filler material is magnetic.

26. A stabilization device according to claim 24 wherein said secondary filler material is softer than said primary mold piece material.

27. A stabilization device according to claim 1 wherein said stabilization device includes a plurality of identical body members hingedly joined.

28. A stabilization device according to claim 1 wherein said body members are separable along each hinge of the stabilization device.

29. A stabilization device comprising a resilient body having an upper surface and a lower surface that diverge from a common vertex to form a wedge shape, each of said upper and lower surfaces including;

a) a respective first set of first teeth distributed about a first axis, said first teeth spaced apart from one another a selected first pitch; and b) a respective second set of second teeth distributed about a second axis, said second teeth spaced apart from one another by a selected second pitch, said second teeth being offset from said first teeth along said second axis.

30. A stabilization device according to claim 29 wherein each of said upper and lower surfaces has a shape selected from a group consisting of a rectangle, a circle, and an oval.

31. A stabilization device according to claim 30 wherein said body member includes a cavity formed therein.

32. A stabilization device according to claim 29 wherein each said respective first set includes at least one first row of first teeth each centered along a respective first axis and each said respective second set includes a plurality of second rows of second teeth each centered along a respective second axis.

33. A stabilization device according to claim 32 wherein each said respective second set includes a pair of outer rows bordering each said respective first set, wherein said outer rows are one-fourth the width of said first rows.

34. A stabilization device according to claim 33 wherein each said respective first set includes a pair of first rows and each said respective second set includes an inner row interposed between said first rows, wherein said inner row is one-half the width of each said first row.

35. A stabilization device according to claim 29 wherein said stabilization device includes a plurality of identical body members severably joined.

* * * * *